US009786112B2

(12) United States Patent
Ito et al.

(10) Patent No.: US 9,786,112 B2
(45) Date of Patent: Oct. 10, 2017

(54) PAPER SHEET HANDLING MACHINE

(71) Applicant: GLORY LTD., Himeji-Shi, Hyogo-Ken (JP)

(72) Inventors: Osamu Ito, Kawaguchi (JP); Masakazu Miwa, Tokyo (JP); Kouichi Maekawa, Tokyo (JP); Fumiaki Koga, Tokyo (JP)

(73) Assignee: GLORY LTD., Himeji-Shi, Hyogo-Ken (JP)

( * ) Notice: Subject to any disclaimer, the term of this patent is extended or adjusted under 35 U.S.C. 154(b) by 15 days.

(21) Appl. No.: 14/852,657

(22) Filed: Sep. 14, 2015

(65) Prior Publication Data

US 2015/0379798 A1 Dec. 31, 2015

Related U.S. Application Data

(63) Continuation of application No. 12/449,206, filed as application No. PCT/JP2007/052187 on Feb. 8, 2007, now Pat. No. 9,147,301.

(51) Int. Cl.
*G07F 7/04* (2006.01)
*G07D 11/00* (2006.01)
(Continued)

(52) U.S. Cl.
CPC ..... *G07D 11/00* (2013.01); *G07D 7/00* (2013.01); *G07D 11/0084* (2013.01);
(Continued)

(58) Field of Classification Search
CPC ..... G07D 11/00; G07D 7/00; G07D 11/0084; G07D 11/0081; G07D 7/12; G07D 7/20;
(Continued)

(56) References Cited

U.S. PATENT DOCUMENTS 6,253,057 B1 * 6/2001 Yamanaka ..... B26D 7/18 270/58.07
2002/0092727 A1 * 7/2002 Kato ..... B65H 29/006 194/302

(Continued)

*Primary Examiner* — Jeffrey Shapiro
(74) *Attorney, Agent, or Firm* — Renner, Kenner, Greive, Bobak, Taylor & Weber

(57) ABSTRACT

A paper sheet handling machine 100 comprises an upper unit 10 having a paper sheet take-in apparatus 120 adapted for taking therein paper sheets, one by one, from the exterior, an upper transport mechanism 201*a* adapted for transporting the paper sheets taken in by the paper sheet take-in apparatus 120, one by one, and a recognition unit 220 adapted for recognizing each paper sheet transported by the upper transport mechanism 201*a*; a lower unit 20 located below the upper unit 10 and having a lower transport mechanism 201*b* provided to receive the paper sheets transferred from the upper transport mechanism 201*a*, one by one, and then further transport the transferred paper sheets, and a plurality of stacking units 106, each adapted for stacking therein the paper sheets transported by the lower transport mechanism 201*b* and sorted based on results obtained by the recognition unit 220. In this case, at least a part of a bottom portion of the upper unit 10 is opened. Additionally, a partition member 30 is provided between the upper unit 10 and the lower unit 20.

17 Claims, 4 Drawing Sheets

(51) Int. Cl.
*G07D 7/00* (2016.01)
*B65H 29/62* (2006.01)

(52) U.S. Cl.
CPC ..... *B65H 29/62* (2013.01); *B65H 2402/441* (2013.01); *B65H 2407/51* (2013.01); *B65H 2601/261* (2013.01); *B65H 2701/1912* (2013.01)

(58) Field of Classification Search
CPC ..... G07D 2207/00; G07D 2211/00; B65H 31/24; B65H 43/04; B65H 37/00; B65H 29/00; B65H 2601/261; B65H 2407/51; B65H 2301/4314; B65H 2701/1912; G03G 21/16; G03G 2221/1687; G03G 2221/1654; G03G 2221/169; G03G 2221/183; G03G 2221/1675; B07B 1/24; B08B 5/00; G07F 7/04; G07F 1/041
USPC ..... 194/206, 207, 347, 348; 209/534; 235/379; 347/138, 152, 34, 36; 399/125, 399/358, 411, 113, 124; 15/421, 246.2, 15/300.1, 345; 55/374, 378; 210/460, 210/463, 510, 454
See application file for complete search history.

(56) References Cited

U.S. PATENT DOCUMENTS

2004/0016621 A1* 1/2004 Jenrick ..... G07F 19/202 194/206
2004/0144695 A1* 7/2004 Kuru ..... B65H 7/06 209/534
2008/0050149 A1* 2/2008 Parks ..... G03G 21/1638 399/124

* cited by examiner

PAPER SHEET HANDLING MACHINE

CROSS-REFERENCE TO RELATED APPLICATION

This application is a continuation of U.S. patent application Ser. No. 12/449,206 filed on Jul. 28, 2009, which is incorporated herein by reference, which was based upon and claimed the benefit of priority from the prior PCT/JP2007/052187 filed on Feb. 8, 2007, the entire contents of which are incorporated herein by reference.

FIELD OF THE INVENTION

The present invention relates to a paper sheet handling machine, which can take in paper sheets, one by one, from the exterior thereof and then sort and store the paper sheets taken in the interior of the machine, in a plurality of stacking units.

BACKGROUND OF THE INVENTION

Conventionally, a banknote handling machine (paper sheet handling machine), which can sort the banknotes deposited from a customer, for each denomination thereof, and then store them therein, has been known. In such a banknote handling machine, the banknotes, when deposited in the machine, are first placed in a hopper by an operator. Then, the banknotes placed in the hopper are taken in the banknote handling machine, one by one, by a banknote take-in apparatus.

As the banknote handling machine as described above, one machine disclosed in JP9-190562A has been known. This banknote handling machine disclosed in JP9-190562 comprises an upper unit and a lower unit. The upper unit and lower unit are respectively composed of a substantially rectangular parallelepiped casing. The upper unit has the banknote take-in apparatus adapted for taking therein the banknotes stored in the hopper, one by one, an upper transport mechanism adapted for transporting the banknotes taken in by the banknote take-in apparatus, one by one, and a recognition unit provided in the middle of the upper transport mechanism and adapted for recognizing each banknote transported by the upper transport mechanism. The lower unit has a lower transport mechanism provided to receive the banknotes transferred from the upper transport mechanism of the upper unit, one by one, and then further transport such received banknotes, and a plurality of stacking units, each for stacking therein the paper sheets transported by the lower transport mechanism and sorted based on results obtained by the recognition unit.

In this banknote handling machine, when some foreign material, such as dirt, dust or the like, is attached to each banknote to be taken in by the banknote take-in apparatus, there is a risk that such foreign material may be attached to the transport mechanism or recognition unit in the banknote handling machine, when a series of processes are provided to each banknote by the banknote handling machine. Especially, in an outlet portion of the banknote take-in apparatus and recognition unit, where a transport path for each banknote is relatively narrowed, the foreign material is likely to be detached from the banknote, thus it may tend to be attached to the outlet portion of the banknote take-in apparatus and recognition unit. With such attachment of the foreign material, misrecognition for each banknote may occur in the recognition unit, and a failure or error during a transport operation may be caused by a jam or the like in the transport mechanism.

In the above banknote handling machine disclosed in JP9-190562A, the recognition unit provided in the upper unit is composed of a pair of rollers (more specifically, a base roller and a detection roller), each adapted for detecting the thickness of the banknotes. In this case, either one of the rollers has a spiral groove formed in an outer-circumferential face thereof, in order to scrape off the foreign material attached to the roller.

In addition, in a banknote authentication apparatus as described in JP10-283520A, a scraper is provided to be in contact with either one of the pair of rollers for detecting the thickness of the banknotes. Namely, this scraper can serve to scrape off the foreign material attached to the outer-circumferential face of the roller, in order to detect the thickness of the banknotes more accurately.

However, in such conventional banknote handling machines as described above, since the upper unit is composed of the casing having a bottom plate, the foreign material detached from each roller of the recognition unit will be accumulated on the bottom plate of the upper unit. Namely, even though the foreign material that would otherwise remain in the outlet portion of the banknote take-in apparatus and recognition unit of the upper unit, where the transport path for each banknote is relatively narrowed, can be positively detached from that portion or unit in the conventional banknote handling machine, such a detached foreign material will be fallen down and eventually accumulated on the bottom plate of the upper unit. Thus, such accumulated foreign material may cause various problems.

DISCLOSURE OF THE INVENTION

The present invention was made in light of the above circumstances. Therefore, it is an object of the present invention to provide a new paper sheet handling machine, which can successfully prevent the accumulation of the foreign material therein that would be caused when the paper sheets are taken in the paper sheet handling machine, with the foreign material, such as dirt, dust or the like, attached thereto, thereby to substantially prevent the misrecognition for the paper sheets in the recognition unit as well as to prevent occurrence of trouble, such as the jam in the transport mechanism, slip off of belts and the like.

A paper sheet handling machine of the present invention comprises: an upper unit having a paper sheet take-in apparatus adapted for taking therein paper sheets, one by one, from the exterior, an upper transport mechanism, at least a part of which is provided to extend in a substantially horizontal direction, and which is adapted for transporting the paper sheets taken in by the paper sheet take-in apparatus, one by one, and a recognition unit provided in the middle of the upper transport mechanism and adapted for recognizing each paper sheet transported by the upper transport mechanism, wherein at least a part of a bottom portion of the upper unit is opened; a lower unit located below the upper unit and having a lower transport mechanism provided to receive the paper sheets transferred from the upper transport mechanism, one by one, and then further transport the transferred paper sheets, and a plurality of stacking units, each adapted for stacking therein the paper sheets transported by the lower transport mechanism and sorted based on results obtained by the recognition unit; and a partition member provided between the upper unit and the lower unit.

According to this paper sheet handling machine, even in the case in which the paper sheets are taken therein, with a foreign material, such as dirt, dust or the like, being attached to the paper sheets, and then the foreign material is detached and fallen from the paper sheets, for example, in an outlet portion of the paper sheet take-in apparatus or recognition unit, where a transport path for each paper sheet is relatively narrowed in the upper unit, the foreign material will be fallen down through an opening formed in the bottom portion of the upper unit and eventually accumulated on a top face of the partition member. Therefore, the operator has only to remove the foreign material accumulated on the top face of the partition member, upon maintenance for the paper sheet handling machine. This can significantly simplify the removal of the foreign material. In addition, this configuration can successfully prevent the foreign material detached from each paper sheet taken in the upper unit, from remaining in this unit. Therefore, a failure or error, upon the recognition for the paper sheets in the recognition unit, caused by such a foreign material accumulated in the upper unit, can be prevented, as well as occurrence of trouble, such as a jam in the upper transport mechanism, slip off of belts and the like, can be prevented.

In the paper sheet handling machine of the present invention, it is preferred that the partition member is composed of a plate member extending in the substantially horizontal direction. With this partition member, the foreign material, detached from the paper sheets taken in the upper unit and then fallen down through the opening formed in the bottom portion of the upper unit, can be securely received by the top face of the partition member extending in the substantially horizontal direction. Thus, the operator can readily perform the removal of the foreign material accumulated on such a substantially horizontal top face of the partition member, upon the maintenance for the paper sheet handling machine. More preferably, the partition member is sized to include at least a portion, in which both the upper transport mechanism and lower transport mechanism are included respectively, when the paper sheet handling machine is seen from above. Namely, since the foreign material is detached and fallen down from the paper sheets when the paper sheets are transported by the upper transport mechanism in the upper unit, it is preferred that the partition member is located just below the upper transport mechanism and sized to cover at least the upper transport mechanism. Further, since some failure or error is likely to occur in the lower transport mechanism if the foreign material fallen from the upper unit reaches the lower transport mechanism, it is also preferred that the partition member is located just above the lower transport mechanism and sized to cover at least the lower transport mechanism.

In the paper sheet handling machine of the present invention, it is preferred that the upper unit can be opened upward, wherein a top face of the partition member is accessible from the exterior, when the upper unit is opened upward. With such configuration, the operator can readily perform the removal of the foreign material accumulated on the top face of the partition member, by only opening the upper unit upward, upon the maintenance for the paper sheet handling machine. More preferably, the partition member can be opened upward while the upper unit is opened upward, wherein the interior of the lower unit is accessible when both of the upper unit and partition member are opened upward. With this configuration, the operator can readily perform the maintenance for the lower transport mechanism, stacking units and like, in the lower unit, by opening the partition member upward, after removing the foreign material on the partition member while the upper unit is opened upward.

In the paper sheet handling machine of the present invention, it is preferred that a through-hole is provided in the lower unit, in order to remove the foreign material accumulated in the lower unit, by suction. With the provision of this through-hole, the operator can readily remove the foreign material accumulated in the lower unit, by suction, after connecting a suction apparatus, such as a cleaner or the like, with the through-hole, upon the maintenance for the paper sheet handling machine.

In the paper sheet handling machine of the present invention, it is preferred that an opening is provided in a bottom portion of the recognition unit, in order to enable the foreign material generated in the recognition unit to be fallen down onto the partition member. While the foreign material is likely to be detached from each paper sheet, in the recognition unit where the transport path for the paper sheet is relatively narrowed in the upper unit, such a foreign material detached from the paper sheet can be readily fallen down onto the partition member, due to the opening provided in the bottom portion of the recognition unit. This can effectively prevent occurrence of the failure or error caused by the accumulation of the foreign material in the recognition unit, upon the recognition for the paper sheets in the recognition unit.

In the paper sheet handling machine of the present invention, it is preferred that the partition member is pivotally attached to an upper portion of the lower unit via a horizontally extending shaft, such that the partition member can be rotated about the shaft while the upper unit is opened upward, wherein a foreign material collecting unit is provided along the shaft, such that, when the partition member is opened upward, the foreign material accumulated on the partition member can slide down along such an inclined partition member, thus being collected in the foreign material collecting unit. This configuration can successfully bring the partition member into an obliquely and upwardly inclined state relative to the horizontally extending shaft, when the partition member is opened upward while the upper unit is opened upward. Therefore, the foreign material once accumulated on the partition member can be securely collected in the foreign material collecting unit, by having the foreign material slide obliquely downward along the partition member. More preferably, a through-hole is provided in the foreign material collecting unit, in order to remove the foreign material collected in the foreign material collecting unit by suction. With the provision of this through-hole, the operator can readily remove the foreign material accumulated in the foreign material collecting unit, by suction, after connecting a proper suction apparatus, such as the cleaner or the like, with the through-hole.

DETAILED DESCRIPTION OF THE INVENTION

Hereinafter, one embodiment of the present invention will be described, with reference to the drawings. In this embodiment, one exemplary case, in which a paper sheet handling machine related to the present invention is used as a banknote handling machine for handling banknotes, will be discussed. However, any other suitable paper sheets than the banknotes may be used as an object to be handled by the paper sheet handling machine of the present invention. It should be construed that this embodiment has no intent to limit the scope of the present invention, but is merely intended to show one preferred example thereof.

First, referring to FIGS. 1 and 2, general construction of the banknote handling machine of the present invention will be discussed.

Figure 1:
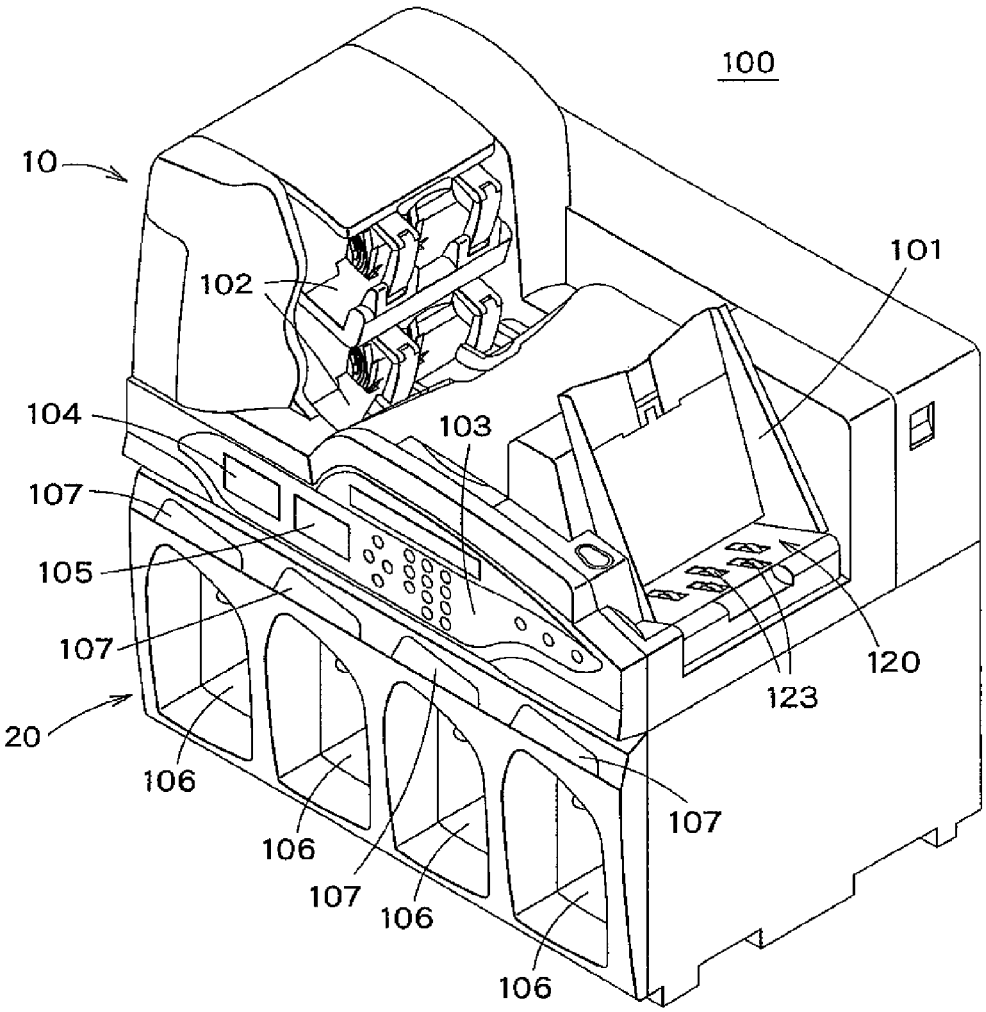
FIG. 1 is a perspective view showing an outline of a banknote handling machine (paper sheet handling machine) of the present invention.
Figure 2:
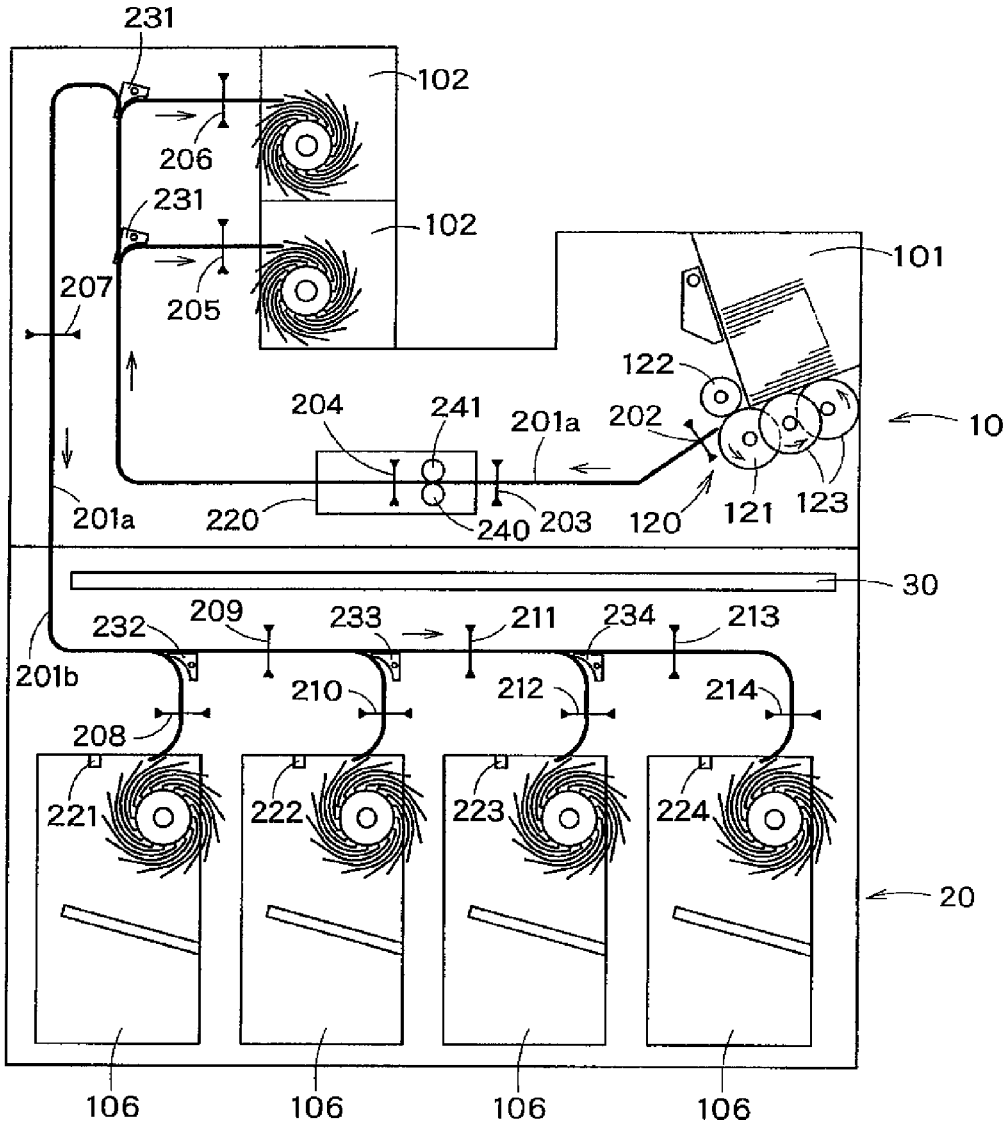
FIG. 2 is a schematic front view showing internal construction of the banknote handling machine shown in FIG. 1.

FIG. 1 is a perspective view showing an outline of the banknote handling machine 100 related to one exemplary embodiment of the present invention, and FIG. 2 is a schematic front view showing internal construction of the banknote handling machine 100 shown in FIG. 1. As shown in FIGS. 1 and 2, the banknote handling machine 100 comprises an upper unit 10, and a lower unit 20 located below the upper unit 10. The upper unit 10 and lower unit 20 are respectively composed of a substantially rectangular parallelepiped casing and configured to be optionally separated from each other. In this case, as shown in FIGS. 1 and 2, the upper unit 10 has a hopper 101, a banknote take-in apparatus 120, two reject units 102, an operation unit 103, a first general display unit 104, a second general display unit 105, and an upper transport mechanism 201*a*. Meanwhile, the lower unit 20 has four stacking units 106, four individual display units 107 and a lower transport mechanism 201*b*.

Now, each component of the upper unit 10 is described. The hopper 101 is configured such that a plurality of banknotes can be placed thereon, in a stacked condition, by an operator. The banknotes once stored in the hopper 101 will be taken in the banknote handling machine 100, one by one, by the banknote take-in apparatus 120. The banknote take-in apparatus 120 is composed of a feed roller 121 adapted for feeding the banknotes into the apparatus, a gate roller (or reversal roller) 122 provided to be opposed to the feed roller 121, thereby forming a gate part between the feed roller 121 and the gate roller 122, and a kicker roller 123 adapted for kicking the banknotes stored in the hopper 101 toward the feed roller 121. The banknotes taken in the upper unit 10 by the banknote take-in apparatus 120 are then transported by the upper transport mechanism 201*a* as will be described later. Each reject unit 102 can serve to discharge the banknote, when this banknote taken in the upper transport mechanism 201*a* by the banknote take-in apparatus 120 is a rejected banknote (e.g., a counterfeit banknote or the like). For instance, a lower one of the two reject units 102 may be used for discharging each counterfeit banknote or the like, while the upper reject unit 102 may be used for storing therein each banknote excluded from ones to be sorted although it has been recognized by a recognition unit 220 as will be described below.

The operation unit 103 includes input keys for inputting instructions of the operator therein. The first general display unit 104 and second general display unit 105 are respectively provided for displaying predetermined data (e.g., graphic data or the like).

Next, each component of the lower unit 20 will be described. As shown in FIG. 2, the lower unit 20 is provided with the lower transport mechanism 201*b*, which is configured to receive the banknotes transferred from the upper transport mechanism 201*a*, one by one. The lower transport mechanism 201*b* is adapted for further transporting the transferred banknotes in the lower unit 20. Each stacking unit 106 is configured to stack therein the banknotes taken in from the hopper 101 by the banknote take-in apparatus 120, for each attribute (e.g., denomination or the like) of the banknotes. Each individual display unit 107 is provided corresponding to each stacking unit 106, and serves to display the number of banknotes stacked in the corresponding stacking unit 106.

While the two reject units 102, four stacking units 106 and four individual display units 107 are respectively provided to the upper unit 10 depicted in FIG. 1, each number of these components can be altered without any limitation.

Next, a transport system and a sensor system of the banknote handling machine 100 will be detailed. As described above, FIG. 2 is a schematic diagram showing general internal construction of the banknote handling machine 100 shown in FIG. 1, and is intended in particular to illustrate the transport system and the sensor system thereof.

As shown in FIG. 2, in the upper unit 10 of the banknote handling machine 100, the upper transport mechanism 201*a* is provided to transport the banknotes taken in from the hopper 101 by the banknote take-in apparatus 120. The upper transport mechanism 201*a* is configured to partly extend in a substantially horizontal direction. Meanwhile, in the lower unit 20, the lower transport mechanism 201*b* is provided to receive the banknotes transferred from the upper transport mechanism 201*a*, one by one, and then transport the transferred banknotes to each stacking unit 106. Usually, each of the upper transport mechanism 201*a* and lower transport mechanism 201*b* is composed of several belt transport mechanisms combined with one another. Various sensors 202 to 214 are provided along the upper transport mechanism 201*a* and lower transport mechanism 201*b*. The sensor 202 provided on the side of an outlet of the hopper 101 and the sensor 203 provided on the side of an inlet of the recognition unit 220 as will be described later can serve to detect whether or not each banknote is securely taken in the upper transport mechanism 201*a*, respectively. The recognition unit 220 provided in the upper transport mechanism 201*a* is composed of various detection units, and serves to detect fitness, authentication, denomination, orientation, face/back and the like of each banknote taken therein from the hopper 101. Additionally, as shown in FIG. 2, a sensor 204 composed of, for example, a transparent sensor, and a pair of rollers 240, 241 adapted for measuring the thickness of each banknote are provided to the upper transport mechanism 201*a*, respectively.

On the downstream side relative to the recognition unit 220 in the upper transport mechanism 201*a*, two diverters 231 are provided in series. Each diverter 231 is configured to feed each banknote that cannot be recognized in the recognition unit 220 or banknote that is excluded from ones to be sorted although it has been recognized by the recognition unit 220, to each corresponding reject unit 102. The sensors 205, 206 can serve to detect that each banknote is fed from each diverter 231 to each corresponding reject unit 102, respectively. Meanwhile, each banknote selected as one to be sorted is detected, about its transported condition, by the sensor 207, and then further transported by the upper transported mechanism 201*a*. Thereafter, this banknote will be transferred from the upper transport mechanism 201*a* of the upper unit 10 to the lower transport mechanism 201*b* of the lower unit 20.

In the lower transport mechanism 201*b*, three diverters 232 to 234 are provided in series. Each diverter 232 to 234 can serve to feed each banknote toward each corresponding one of the four stacking units 106, according to, for example, the denomination or the like of the banknote. In this way, each banknote that has been recognized, about the denomination or the like thereof, by the recognition unit 220, is stored in a suitable one of the four stacking unit 106. The sensors 208 to 214 can serve to detect whether or not the sorting operation for the banknotes from the lower transport mechanism 201*b* into each stacking unit 106 has been appropriately performed, respectively. Further, the storage condition of the banknotes in each stacking unit 106 is detected by each corresponding residue detection sensor 221 to 224.

Figure 3:
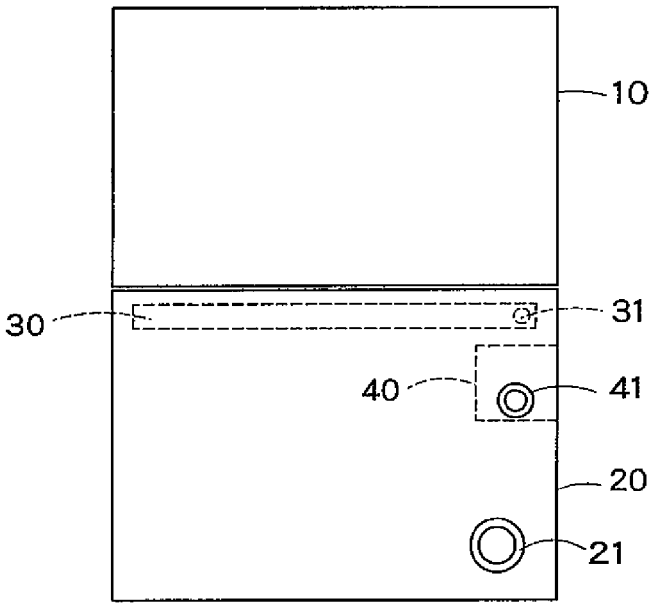
FIG. 3 is a schematic side view of the banknote handling machine shown in FIG. 1, illustrating a state in which an upper unit and a partition member are not opened upward, respectively.
Figure 4:
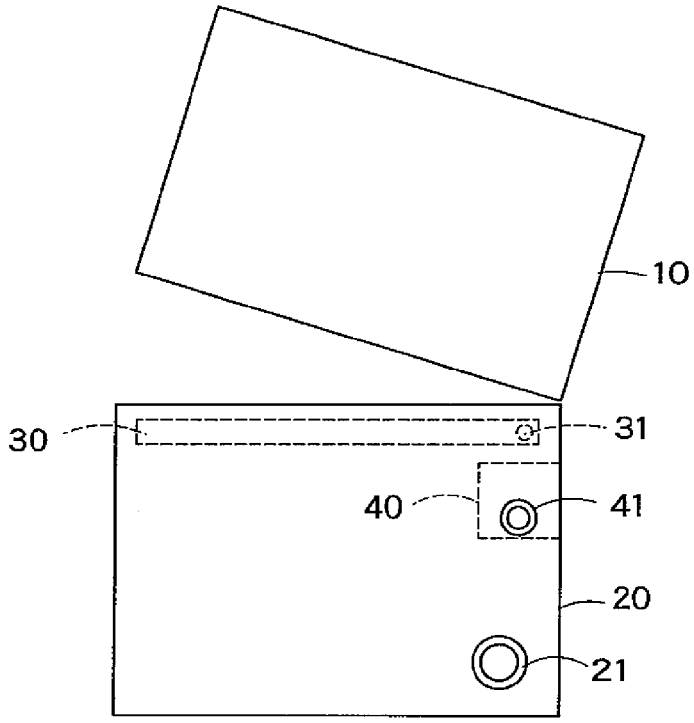
FIG. 4 is a schematic side view of the banknote handling machine shown in FIG. 1, illustrating a state in which the upper unit is opened upward.
Figure 5:
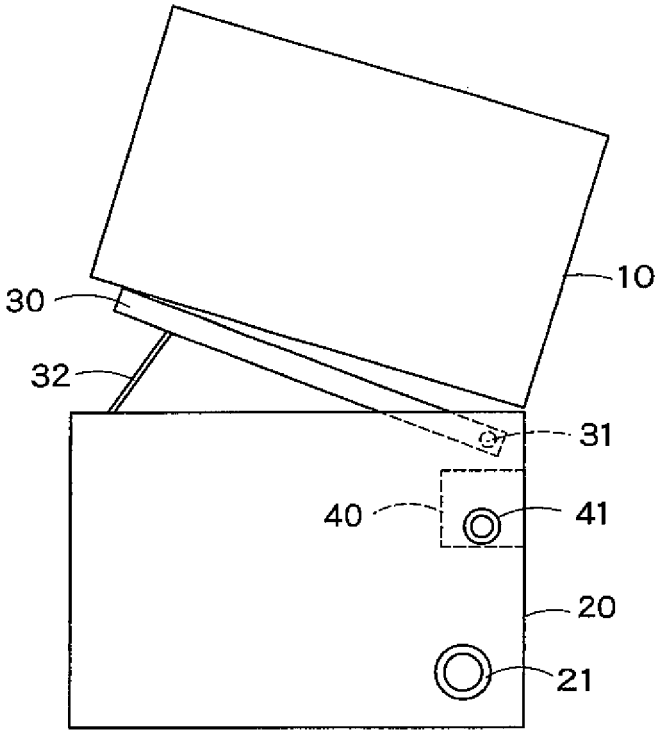
FIG. 5 is a schematic side view of the banknote handling machine shown in FIG. 1, illustrating a state in which both of the upper unit and partition member are opened upward.

One feature of the banknote handling machine 100 of this embodiment is that a partition member 30 is provided between the upper unit 10 and the lower unit 20. Now, referring to FIGS. 3 to 5, specific construction of this partition member 30 and a relationship thereof to the upper unit 10 and lower unit 20 will be described. FIGS. 3 to 5 are schematic side views of the banknote handling machine 100 shown in FIG. 1, respectively. FIG. 3 is a side view showing a state in which the upper unit 10 and partition member 30 are not opened upward, respectively. FIG. 4 is a side view showing a state in which the upper unit 10 is opened upward, and FIG. 5 is a side view showing a state in which both of the upper unit 10 and partition member 30 are opened upward.

The upper unit 10 has a bottom portion configured to be wholly or at least partly opened. It is preferred that the bottom portion of the upper unit 10 is wholly opened. However, when the banknote handling machine 100 is seen from above, at least a region of the bottom portion of the upper unit 10 just below the upper transport mechanism 201*a* may be opened. The reason for such a bottom portion of the upper unit 10 being wholly or at least partly opened is that foreign material can be fallen onto the partition member 30, through an opening of the bottom portion of the upper unit 10, when the foreign material is detached from each banknote transported by the upper transport mechanism 201*a* in the upper unit 10.

As shown in FIGS. 4 and 5, the upper unit 10 can be opened upward and the operator can access the partition member 30 from the exterior while the upper unit 10 is opened upward. In this way, upon maintenance for the banknote handling machine 100, the operator can readily remove the foreign material accumulated on a top face of the partition member 30, by only opening the upper unit 10 upward.

Further, an opening (not shown) is formed in a bottom portion of the recognition unit 220 provided in the upper unit 10, in order to allow the foreign material generated in the recognition unit 220 to be fallen onto the partition member 30. Namely, the foreign material is likely to be detached from each banknote in the recognition unit 220, where a transport path for the banknotes is relatively narrowed in the upper unit 10. However, the opening formed in the bottom portion of the recognition unit 220 can enable the foreign material detached from each banknote to be readily fallen down onto the partition member 30. Thus, occurrence of a failure or error, upon the recognition for the banknotes in the recognition unit 220, caused by accumulation of the foreign material in the recognition unit 220, can be prevented.

Next, the lower unit 20 will be described. An upper portion of the lower unit 20 can also be opened. This can enable the operator to access the lower transport mechanism 201*b* and each stacking unit 106 in the lower unit 20, upon the maintenance for the banknote handling machine 100. Furthermore, as shown in FIG. 3, a through-hole 21 that can be optionally opened and closed is provided in a lower region of a side face of the lower unit 20. Thus, the operator can connect a suction apparatus, such as a cleaner or the like, with the through-hole 21, after opening the through-hole 21, upon the maintenance for the banknote handling machine 100, and then remove the foreign material accumulated in the lower unit 20, by suction.

As shown in FIGS. 2 and 3, the partition member 30 provided between the upper unit 10 and the lower unit 20 is a plate member extending in a substantially horizontal state. A top face of the partition member 30 has a substantially rectangular shape, and one side of such a rectangular partition member 30 is pivotally attached to an upper portion of the lower unit 20 via a horizontally extending shaft 31. Thus, as shown in FIGS. 4 and 5, the partition member 30 can be rotated upward about the shaft 31 while the upper unit 10 is opened upward. Namely, the partition member 30 can be opened upward, while being rotated upward from such a substantially horizontal state as shown in FIG. 4. Thereafter, the partition member 30 can be kept in such an opened state, by placing a stopper 32, which is an attachment of the banknote handling machine 100, between the partition member 30 and the lower unit 20 as shown in FIG. 5.

It is preferred that the partition member 30 is sized to cover the entire bottom portion of the upper unit 10 or has a size substantially the same as the size of a bottom face of the upper unit 10. However, the partition member 30 may be sized to cover at least the opening formed in the bottom portion of the upper unit 10. More preferably, the partition member 30 is sized to include at least a portion in which both the upper transport mechanism 201*a* and lower transport mechanism 201*b* are included respectively, when the banknote handling machine 100 is seen from above. Namely, since the foreign material is detached and fallen down from each banknote when the banknote is transported by the upper transport mechanism 201*a* in the upper unit 10, the partition member 30 is preferably provided in a position just below the upper transport mechanism 201*a*, while having a size to cover at least the upper transport mechanism 201*a*. Furthermore, since some failure or error may tend to occur in the lower transport mechanism 201*b* if the foreign material that has been fallen from the upper unit 10 reaches the lower transport mechanism 201*b* of the lower unit 20, it is preferred that the partition member 30 is provided in a position just above the lower transport mechanism 201*b*, while having a size to cover at least the lower transport mechanism 201*b*.

Additionally, as shown in FIG. 5, the partition member 30 can be opened upward while the upper unit 10 is opened upward. Accordingly, when such a partition member 30 is opened upward, the lower transport mechanism 201*b*, stacking units 106 and the like in the lower unit 20 will be accessible, respectively. Therefore, upon the maintenance for the banknote handling machine 100, the operator can first remove the foreign material on the partition member 30 while the upper unit 10 is opened upward, and then readily perform the maintenance for the lower transport mechanism 201*b*, stacking units 106 and the like, in the lower unit 20, by opening the partition member 30 upward.

Moreover, a foreign material collecting box 40 is provided, just below and along the shaft 31, to which the partition member 30 is pivotally attached. With such configuration, when the partition member 30 is opened upward as shown in FIG. 5, the foreign material accumulated on the partition member 30 will slide down along such an inclined partition member 30, thus being securely collected in the foreign material collecting box 40. Preferably, a through-hole 41 that can be optionally opened and closed is provided in the foreign material collecting box 40, in order to remove the foreign material collected in the foreign material collecting box 40, by suction. With the provision of such a through-hole 41, the operator can connect an appropriate suction apparatus, such as the cleaner or the like, with the through-hole 41, while the through-hole 41 is opened, and then readily remove the foreign material accumulated in the foreign material collecting box 40, by suction.

As stated above, in the banknote handling machine 100 of this embodiment, at least a part of the bottom portion of the upper unit 10 is opened, and the partition member 30 is provided between the upper unit 10 and the lower unit 20. With this configuration, even when the banknote having the foreign material attached thereto is taken in the upper unit 10 and such foreign material is then detached and fallen down from the banknote, for example, in an outlet portion of the banknote take-in apparatus 120 or recognition unit 220, where the transport path for each banknote is relatively narrowed in the upper unit 10, such a foreign material will be eventually accumulated on the top face of the partition member 30, after fallen down through the opening formed in the bottom portion of the upper unit 10. Therefore, the operator has only to remove the foreign material accumulated on the top face of the partition member 30, upon the maintenance for the banknote handling machine 100. This can significantly simplify the removal of the foreign material. In addition, this configuration can successfully prevent the foreign material detached from each banknote taken in the upper unit 10, from remaining in the upper unit 10. Therefore, the failure or error, upon the recognition for the banknotes in the recognition unit 220, caused by the foreign material accumulated in the upper unit 10, can be prevented, as well as occurrence of inconvenience, such as a jam in the upper transport mechanism 201*a*, slip off of the belts and the like, can be prevented.

As described above, since the partition member 30 is composed of the plate member extending in the substantially horizontal direction, the foreign material detached from each banknote taken in the upper unit 10 and then fallen down through the opening formed in the bottom portion of the upper unit 10 will be received on such a horizontally extending top face of the partition member 30. Therefore, the operator can readily remove the foreign material accumulated on such a substantially horizontal top face of the partition member 30, upon the maintenance for the banknote handling machine 100. Additionally, since the upper unit 10 can be opened upward, the top face of the partition member 30 will be accessible from the exterior, when the upper unit 10 is opened upward. Thus, the operator can readily remove the foreign material accumulated on the top face of the partition member 30, by only opening the upper unit 10 upward, upon the maintenance for the banknote handling machine 100. Furthermore, since the partition member 30 can also be opened upward while the upper unit 10 is opened upward, the interior of the lower unit 20 will be accessible when both of the upper unit 10 and partition member 30 are opened upward. Therefore, upon the maintenance for the banknote handling machine 100, the operator can first remove the foreign material on the partition member 30 while the upper unit 10 is opened upward, and then perform the maintenance for the lower transport mechanism 201*b*, stacking units 106 and the like, in the lower unit 20, by opening the partition member 30 upward.

What is claimed is:

1. A paper sheet handling machine, comprising:

a take-in unit configured to take therein paper sheets, one by one, a transport unit configured to transport the paper sheets taken in by the take-in unit, one by one, a recognition unit configured to recognize each of the paper sheets transported by the transport unit, a foreign-material receiving unit provided below the recognition unit and configured to receive a foreign material fallen down from the recognition unit, and a stacking unit configured to stack therein each of the paper sheets sorted based on results obtained by the recognition unit, wherein a position of the foreign-material receiving unit, relative to a position of the stacking unit, is configured to be changed.

2. The paper sheet handling machine according to claim 1, wherein the foreign-material receiving unit is provided above the plurality of stacking unit.

3. The paper sheet handling machine according to claim 1, wherein the transport unit includes: an upper transport unit provided with the recognition unit thereto, and a lower transport unit provided below the upper transport unit and extending in a direction opposite to another direction of the upper transport unit, and the foreign-material receiving unit is located below the upper transport unit and above the lower transport unit.

4. The paper sheet handling machine according to claim 1, wherein the transport unit includes: an upper transport unit provided with the recognition unit thereto, and a lower transport unit provided below the upper transport unit and configured to transport the paper sheets in a transport direction, the transport direction including a horizontal component opposite to another horizontal component included in another transport direction in which the upper transport unit is configured to transport the paper sheets, and the foreign-material receiving unit is located below the upper transport unit and above the lower transport unit.

5. The paper sheet handling machine according to claim 2, comprising:

an upper unit provided with the take-in unit and the recognition unit and a lower unit provided with the stacking unit, wherein the transport unit includes an upper transport unit provided in the upper unit and a lower transport unit provided in the lower unit, and the foreign-material receiving unit is located between a substantially horizontal portion of the upper transport unit and a substantially horizontal portion of the lower transport unit.

6. The paper sheet handling machine according to claim 1, wherein the foreign-material receiving unit is formed to overlap both the take-in unit and the recognition unit in a plan view.

7. The paper sheet handling machine according to claim 5, wherein the foreign-material receiving unit is formed to overlap both the upper transport unit and the lower transport unit in a plan view.

8. The paper sheet handling machine according to claim 1, wherein the foreign-material receiving unit is composed of a plate member extending in a substantially horizontal direction.

9. The paper sheet handling machine according to claim 1, wherein an upper unit is openable upward, and a top face of the foreign-material receiving unit is accessible when the upper unit is opened upward.

10. The paper sheet handling machine according to claim 9, wherein the foreign-material receiving unit is movable only while the upper unit is opened upward, and the inside of a lower unit is accessible by moving the foreign-material receiving unit.

11. The paper sheet handling machine according to claim 9, wherein the foreign-material receiving unit is movable only while the upper unit is opened upward, and a lower transport unit is accessible by moving the foreign-material receiving unit.

12. The paper sheet handling machine according to claim 10, wherein the foreign-material receiving unit is pivotally attached to an upper portion of the lower unit via a horizontally extending shaft, such that the foreign-material receiving unit is rotatable about the shaft while the upper unit is opened upward.

13. The paper sheet handling machine according to claim 12, further comprising a stopper adapted for keeping the foreign-material receiving unit in an opened state, wherein the foreign-material receiving unit is kept open with the stopper placed between the foreign-material receiving unit and the lower unit.

14. The paper sheet handling machine according to claim 1, wherein an opening is provided in a bottom portion of the recognition unit, in order to allow the foreign material to fall down onto the foreign-material receiving unit from the recognition unit.

15. The paper sheet handling machine according to claim 5, wherein an opening is provided in a bottom portion of the upper unit, in order to allow the foreign material to fall down onto the foreign-material receiving unit from the upper unit.

16. The paper sheet handling machine according to claim 15, wherein the foreign-material receiving unit is provided, in order to receive the foreign material fallen down through the opening from the take-in unit.

17. A paper sheet handling machine, comprising:

an upper unit that includes an upper transport unit for transporting paper sheets, one by one, a recognition unit configured to recognize each of the paper sheets transported by the upper transport unit, a lower unit that includes a lower transport unit for transporting paper sheets, one by one, the lower transport unit being connected to the upper transport unit, a foreign-material receiving unit provided between the upper transport unit and the lower transport unit, in order to receive the foreign material fallen down from the upper transport unit, and a stacking unit configured to stack therein each of the paper sheets sorted based on results obtained by the recognition unit, wherein a position of the foreign-material receiving unit, relative to a position of the stacking unit, is configured to be changed.

* * * * *